United States Patent [19]

Atwater

[11] Patent Number: 4,807,401

[45] Date of Patent: Feb. 28, 1989

[54] PROCESS AND APPARATUS FOR PROVIDING CUTTING EDGES

[75] Inventor: Robert M. Atwater, Centerville, Mass.

[73] Assignee: The Gillette Company, Boston, Mass.

[21] Appl. No.: 62,911

[22] Filed: Jun. 17, 1987

[51] Int. Cl.[4] ..... B24B 3/48

[52] U.S. Cl. ..... 51/285; 51/80 BS; 76/86; 76/DIG. 9

[58] Field of Search ..... 51/74 BS, 80 R, 80 A, 51/80 B, 80 BS, 81 R, 81 BS, 82 R, 82 BS, 87 R, 87 BS, 285; 76/86, 87, DIG. 9

[56] References Cited

U.S. PATENT DOCUMENTS

| | | | |
|---|---|---|---|
| 1,734,494 | 11/1929 | Kohlmiller | 51/80 BS |
| 1,828,663 | 10/1931 | Jopp | 51/80 A |
| 1,941,501 | 1/1934 | Steiner | 51/80 BS |
| 3,461,616 | 8/1969 | Nissen et al. | 51/285 X |
| 3,494,081 | 2/1970 | Taylor et al. | 51/285 |
| 4,265,055 | 5/1981 | Cartwright et al. | 51/285 X |
| 4,608,782 | 9/1986 | Chylinski | 51/285 X |
| 4,723,375 | 2/1988 | Linden | 51/102 |

*Primary Examiner*—Robert P. Olszewski
*Attorney, Agent, or Firm*—John P. Morley

[57] ABSTRACT

Novel methods and apparatus for providing a facet on opposed surfaces of a cutting instrument such as a razor blade or the like. Essentially, the methods and apparatus are designed to initially abrade opposed surface portions of the instrument concurrently with a relatively high degree of coarseness at a relatively low included angle and thereafter concurrently abrading the opposed surface portions with progressively decreasing degrees of coarseness at progressively increasing included angles. The facets provided by the methods and apparatus on the opposed surfaces of the instrument have a surface in which the included angle decreases as the distance from the edge of the instrument increases.

21 Claims, 4 Drawing Sheets

PROCESS AND APPARATUS FOR PROVIDING CUTTING EDGES

BACKGROUND OF THE INVENTION

1. The Field of the Invention

This invention relates to novel, improved processes and apparatus for producing cutting surfaces for cutting instruments. More particularly, the present invention relates to novel, improved processes and apparatus for producing razor blades and the like.

2. Description of the Prior Art

Presently, razor blades are produced by way of continuous, high-speed mass production techniques involving a plurality of sequential abrading operations to provide the cutting surface including the cutting edge. Each abrading operation provides a facet on opposed surfaces of the cutting surface and the facet may or may not be modified by subsequent abrading operations. Normally, at least three abrading operations are required to provide the facets defining the cutting surface of the finished razor blade. The first operation is the grinding operation and involves abrading opposed surfaces of a continuous sheet of metal to provide a first or "ground" facet on opposed surfaces. Thereafter the metal sheet is subjected to a rough honing operation to provide a second facet or "rough honed facet" on the surfaces while a finish honing operation provides the cutting edge facets for opposed edge surfaces of the blade. Additional details relating to present commercial razor blade manufacturing processes and apparatus can be found in commonly owned U.S. Pat. No. 3,461,616. As disclosed there, a continuous metal strip is subjected to a grinding operation, a rough honing operation and a final honing operation which provides a convex cutting edge. U.S. Pat. No. 3,461,616 is expressly incorporated herein in its entirety by reference.

The processes and apparatus disclosed in U.S. Pat. No. 3,461,616 represent a significant advance in the high-speed, continuous manufacture of razor blades. Essentially, the disclosed processes and apparatus include the three conventional abrading operations, i.e., the grinding, rough honing and finish honing operations. In the grinding operation, one of the opposed edge surfaces of a strip of blade metal is abraded first while the other opposed surface is abraded later to provide the ground facet of the cutting surface. In both the rough and finish honing operations, the opposed surfaces are abraded substantially simultaneously since the abrading means involved includes two juxtaposed abrading wheels. The novel and distinctive feature presented in the processes and apparatus of U.S. Pat. No. 3,461,616 involves the finish honing operation. In this operation, the opposed surfaces of the blade's cutting surface providing the cutting edge is abraded with abrading means arranged and adapted to initially abrade opposed edge surfaces at a relatively high included angle and thereafter abrade the opposed edge surfaces at progressively decreasing included angles to provide curved, convex cutting edge facets on the opposed surfaces. The finish honing operation of U.S. Pat. No. 3,461,616 provides several distinct advantages in commercial razor blade manufacturing processes. The most significant advantage involves the achievement of an increase in the production rate of razor blades by about five or more times.

In the processes and apparatus of U.S. Pat. No. 3,461,616, the grinding operation has been found to be a factor having an effect on the overall efficiency of the production process. Oftentimes, the grinding operation leaves a residual wire or burr at the edge of the ground surface and removal of the wire increases wear of the abrading surfaces in the entry region of the abrading means providing the rough honed facet. Additionally, automatic monitoring and adjusting means are normally arranged between the grinding and rough honing stations to detect irregularities in the ground facets and to signal appropriate adjustments to the grind station to compensate for detected irregularities. The monitoring and adjustment means are expensive, highly sophisticated and can have a limiting effect on the production rate. Accordingly, although the processes and apparatus of U.S. Pat. No. 3,461,616 are highly efficient and cost effective, there still remains a need in the art for processes and apparatus providing maximized efficiency and cost effectiveness in the mass volume production of razor blades having high quality performance characteristics. The present invention is addressed to that need and provides an extremely effective response to it.

BRIEF SUMMARY OF THE INVENTION

This invention presents to the art novel, improved processes and apparatus for producing cutting surfaces for cutting instruments which are especially adaptable to razor blade manufacture. Essentially, the novel processes and apparatus are designed to abrade a portion of opposed surfaces selected to carry the cutting surface to provide rough honed facets on the surfaces. The abrading operation involves abrading means having the capability for initially concurrently abrading the surfaces with a relatively high degree of coarseness at a relatively low included angle and thereafter abrading the surfaces concurrently with progressively decreasing degrees of coarseness at progressively increasing included angles. In this way, the surfaces of the metal strip are initially subjected to a grinding operation but, as abrading continues across the axial length of the metal strip, the surfaces are subjected to a rough honing operation to provide rough honed facets on the finished abraded surfaces. The cutting edge facets can be provided on the opposed edge surfaces by known finish honing operations. Accordingly, razor blades of the present invention have a cutting surface defined by rough honed and finished honed facets on opposed surfaces of the blade.

DESCRIPTION OF PREFERRED EMBODIMENTS

Figure 1:
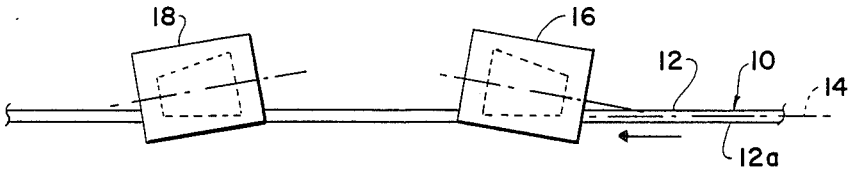
FIG. 1 is a diagrammatic side view of apparatus of the present invention used in manufacturing razor blades.
Figure 2:
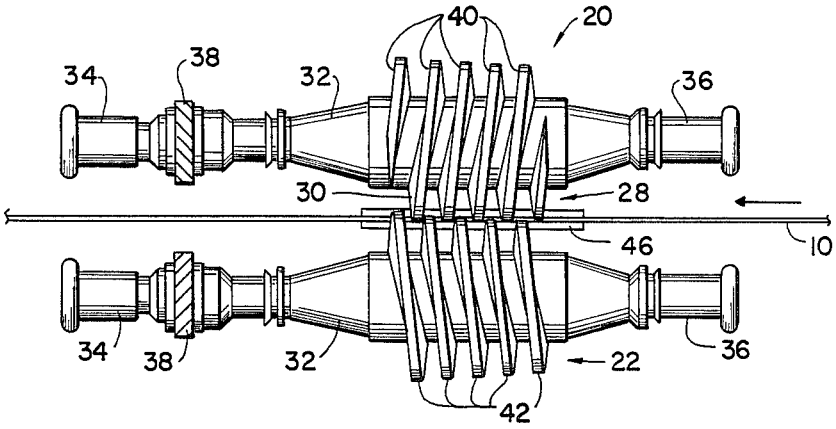
FIG. 2 is a diagrammatic top view of two abrading wheels employed in the preferred practice of the invention.
Figure 3:
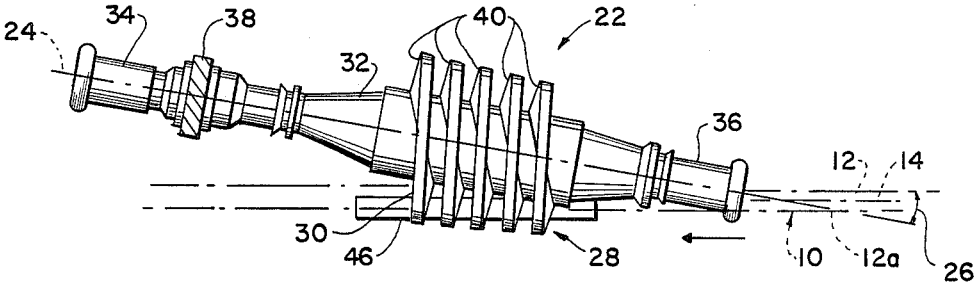
FIG. 3 is a diagrammatic side view of the two abrading wheels of FIG. 2.
Figure 4:
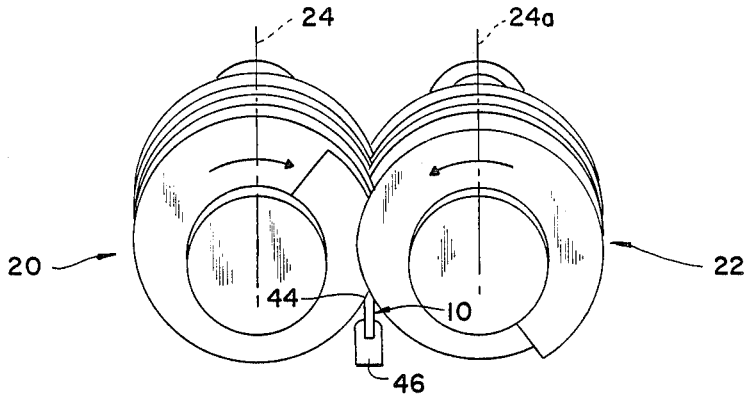
FIG. 4 is a diagrammatic right end view of the two abrading wheels of FIG. 2.

FIG. 1 illustrates an arrangement of apparatus suitable for providing a cutting surface on one edge of a razor blade in accordance with the practice of the invention. A razor blade stock in the form of a thin metal strip 10 of uniform width having top edge 12 and bottom edge 12a is arranged to be driven along a path defining a plane 14 for moving opposed surfaces of edge 12 into abrading relationship with abrading stations 16 and 18. Abrading station 16 includes two abrading wheels 20 and 22 (FIGS. 2–4). Each wheel 20 and 22 is rotatable about spaced, coplaner (preferably parallel) axes 24 and 24a (FIG. 4) which define a plane. Axes 24 and 24a are arranged to form an angle 26 (tilt angle) between the plane of axes 24 and 24a and the path of top edge 12 (i.e., plane 14). Abrading wheels 20 and 22 are preferably arranged in juxtaposed interengagement and have the capability to concurrently abrade opposed surfaces of strip 10 near edge 12 with a relatively high degree of coarseness and at a relatively low included angle at their entry or leading ends 28 (FIG. 2). Thereafter, as strip 10 is moved from entry ends 28 toward exit or trailing ends 30 of wheels 20 and 22, the wheels concurrently abrade the surface portions with progressively decreasing degrees of coarseness and at progressively increasing included angles. The abrading of the opposed surfaces in station 16 provides a rough honed facet 56 on opposed surfaces of cutting surface 50 (FIG. 5) in which the included angle of the facet surface progressively decreases as the distance from the edge 54 increases.

Figure 5:
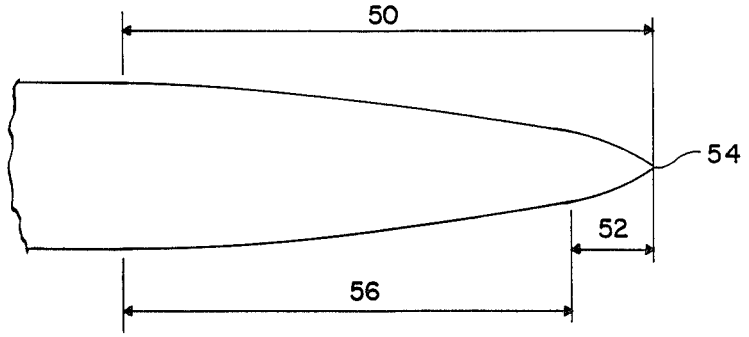
FIG. 5 is an enlarged diagram of the configuration of a cutting surface of a razor blade produced in accordance with the practice of the invention.

After exiting station 16, strip 10 is moved to abrading station 18 where cutting edge facets 52 (FIG. 5) are provided for opposed surfaces of cutting surface 50 (FIG. 5). Cutting edge facets 52 may be provided with apparatus of known design such as by two juxtaposed abrading wheels rotatably mounted and arranged to abrade opposed surfaces of edge 12. Preferably, cutting edge facets 52 are provided in accordance with the processes and apparatus disclosed in referenced U.S. Pat. No. 3,461,616 mentioned before. The finished blade consists of to facets on each opposed surface of cutting surface 50. These facets are shown in FIG. 5 as rough honed facets 56 and cutting edge facets 52. Representative dimensions of opposed surfaces of cutting surface 50 of razor blades produced in accordance with the practice of the present invention are between about 0.010 to about 0.025 inch. Representative dimensions of cutting edge facets 52 are between about 0.0006 to about 0.008 inch while representative dimensions of rough honed facets 56 are between about 0.002 to about 0.0244 inch.

Referring now to FIGS. 2–4, abrading wheels 20 and 22 are of modified frustoconical configuration mounted for rotation about spaced parallel axes 24 and 24a to provide a tilt angle 26 between the plane of axes 24 and 24a and path of edge 12. Each wheel is mounted on a spindle 32 including bearing mounts 34 and 36 with a drive gear 38 positioned on each spindle between the bearing mounts and the wheels. Spindles 32 are mounted in suitable bearing blocks (not shown) for rotation. The circumferential surface of each wheel has spiral helixes formed on it to define a plurality of lands 40 providing or carrying an abrasive surface 42. Abrasive surface 42 may be any of the known grades of abrasive materials such as carbides, nitrides, alumina or diamond among others suitable for abrading razor blade metals. Preferably, the wheels are interengaged to form a nip 44 (FIG. 4) through which strip 10 passes while supported by holder 46 as best shown in FIG. 4. The diameter of each wheel changes along its length so that each wheel is effectively tapered and accordingly, the angle between abrading surfaces 42 at nip 44 changes along the axial length of interengaged wheels 20 and 22. The diameters of wheels 20 and 22 are at the minimum at entry ends 28 and thereafter, the wheel diameters progressively increase toward exit ends 30 so that the : included angle of abrading at entry ends 28 is relatively low but progressively increases along the wheel lengths to exit ends 30. Representative illustrative relatively low included angles of abrading are between about 10° to about 17° and these low included angles progressively increase to included angles of abrading between about 14.5° to about 21.5° . Representative illustrative diameters for wheels 20 and 22 at entry ends 28 are between about 4.5 to about 6.5 inches and representative illustrative diameters for the wheels at exit ends 30 are between about 4.6 to about 6.6 inches.

Figure 7:
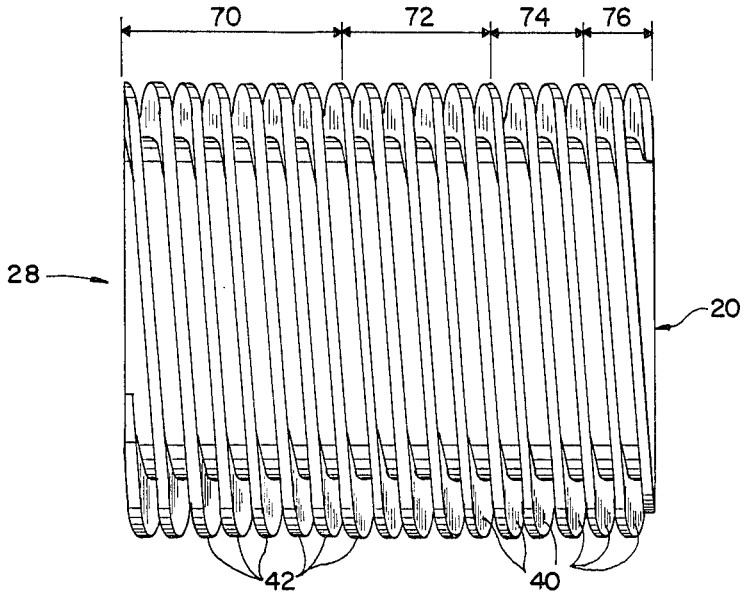
FIG. 7 is a diagrammatic illustrative top view of the abrading wheels of FIGS. 2–4 showing variations in the degree of abrasiveness provided by the wheels.

As shown in FIG. 7, each wheel is divided into sections 70, 72, 74 and 76 providing different degrees of coarseness for abrading surfaces 42 in each section. The degree of coarseness of abrading surfaces 42 in section 70 is relatively high while the degree of coarseness of surfaces 42 in sections 72, 74 and 76 progressively decreases. In this way, the opposed surface portions of strip 10 encounter a high degree of coarseness at entry ends 28 which abrades the surfaces to provide transient ground facets on the surfaces which are progressively modified over the length of the wheels to provide rough honed facets on the opposed surface portions emerging from exit ends 30.

Figure 8:
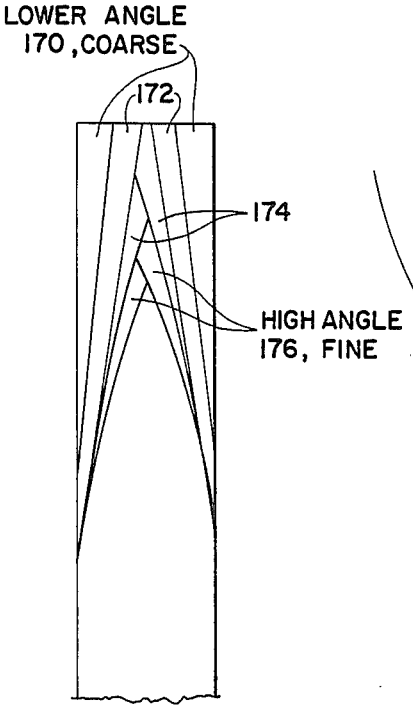
FIG. 8 is a diagrammatic illustration of the abrading action performed on a cross-section of a razor blade strip material by the abrading wheels of FIG. 4.

The abrading action of wheels 20 and 22 will be better appreciated by reference to FIG. 8 which diagrammatically illustrates the abrading action performed by sections 70, 72, 74 and 76 (FIG. 7) on a cross-section of strip 10. As can be seen, section 70 which provides a relatively high degree of coarseness in combination with a relatively low included angle of abrading removes segments 170 to provide ground facets. However, sections 72, 74 and 76 provide progressively decreasing degrees of coarseness and progressively increasing included angles of abrading to remove segments 172, 174 and 176 respectively and provide rough honed facets on the opposed edge surfaces. Accordingly, the abrading action of wheels 20 and 22 effectively combines the abrading of the ground and rough honed facets into a single operation. The appearance of the resulting rough honed facets depends upon the differentials existing between the included angles of abrading provided by each of sections 70–76 and/or upon the differentials between the degree of coarseness provided by each section. When viewed with the eyes, the resulting rough honed facets produced on opposed surfaces of cutting surface 50 appear to be facets having a continuous surface. Under magnification, some of the rough honed facets provided in the practice of the invention appear to comprise a plurality of individual adjacent facets of narrow width. However, in the preferred practice of the invention, the widths of any individual adjacent facets are so narrow they are resulting rough honed facet presents a convex surface in which the included angle of the surface progressively decreases as the distance from edge 54 (FIG. 5) increases. In the preferred practice of the invention, the resulting rough honed facets have a convex surface as shown in FIG. 5 in which the included angle progressively decreases in a substantially continuous fashion as the distance from edge 54 increases.

Figure 6:
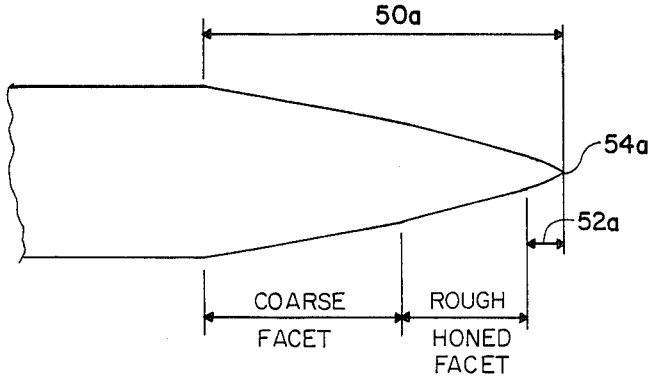
Fig. 6 PRIOR ART
FIG. 6 is an enlarged diagram of the configuration of a cutting surface of a razor blade produced in accordance with the practice of the invention of U.S. Pat. No. 3,461,616.

The differences between razor blades produced in accordance with the practice of the present invention and blades produced by known production techniques will be better appreciated by reference to FIGS. 5 and 6. FIG. 6 diagrammatically illustrates the configuration of a cutting surface 50*a* of a razor blade produced in accordance with the invention of U.S. Pat. No. 3,461,616. As can be seen in FIG. 6, cutting surface 50*a* includes cutting edge facets 52*a* on opposed surfaces of cutting surface 50*a*. Cutting edge facets 52*a* are convex surfaces in which the included angle of the convex surfaces progressively decreases as the distance from edge 54*a* increases. Cutting surface 50*a* also includes distinct rough honed and coarse facets on opposed surfaces. The included angles of these facets are essentially straight and are lower for each facet as the distance from edge 54*a* increases. Accordingly, cutting surface 50*a* has three visually distinct facets provided by the grinding, rough honing and finish honing operations. In contrast, cutting surface 50 of FIG. 5 includes only two facets on opposed surfaces, rough honed facets 56 and cutting edge facets 52 and both facets have convex surfaces so that the included angle of the facet surfaces progressively decreases as the distance from edge 54 increases. The opposed convex surfaces provide a cutting surface having a relatively thin cutting edge coupled with improved cross-sectional strength for the cutting surface thereby providing improved performance characteristics in terms of shaveability and durability.

As mentioned, the plane of axes 24 and 24*a* and path of edge 12 are arranged to provide a tilt angle 26. As shown in FIGS. 3 and 4, tilt angle 26 is reversed from the tilt angle of the wheels shown in FIGS. 3 and 4 of U.S. Pat. No. 3,461,616. The combination of the reverse tilt angle and the design features of the abrading means of the present invention cooperate to provide an extremely efficient and rapid removal of metal in the manner shown in FIG. 8. As shown in FIG. 8, the abrading action achieved by the cooperation between the tilt angle and the abrading means removes metal from the opposed surfaces of strip 10 at progressively higher included angles with successive cuts.

In this way, progressively decreasing amounts of metal are removed from the opposed surfaces as the surfaces are moved toward exit ends 30 of wheels 20 and 22. Accordingly, sections 70 and 72 having the higher degrees of coarseness are arranged to achieve maximized effectiveness in performing the function they are designed to perform, and remove the greater amount of metal. Sections 74 and 76 having the lesser or finer degree of coarseness remove lesser amounts of metal, and the finer abrading action in these sections is directed progressively toward the edge. The abrading action achieved through the cooperation between the tilt angle and the design features of the abrading means permits strip 10 to be moved through wheels 20 and 22 at higher speeds. Reverse tilt angle 26 can be varied over a wide range depending upon various factors including the length or diameter of the wheels or the orientation of the axes of the wheels or variations in abrading angles or in the degree of coarseness desired in the sections of the abrading wheels. Illustrative suitable reverse tilt angles 26 include angles between about 0.3° to about 10° and preferably between about 0.5° to about 5°.

Figure 9:
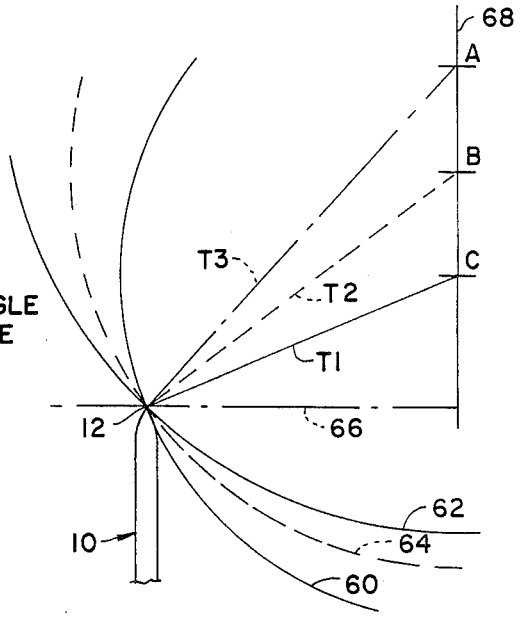
FIG. 9 is a geometric diagram illustrating the contour and mounting of the wheels of FIG. 2.

FIG. 9 illustrates the geometry of the tilt angle 26 of one of the abrading wheels 20 or 22 relative to the path of edge 12 of blade 10. As shown, the smaller or entry circumference of the wheel at entry end 28 is indicated by arc or ellipse 60 while the larger, or exit circumference at exit end 30 is indicated by arc or ellipse 62. An intermediate circumference is indicated as arc or ellipse 64. The path of the blade edge 12 (and plane 14) are perpendicular to line 66 and to the paper. Axis 24 (or 24*a*) of the wheel is indicated by line 68 and the position of axis 24 in the longitudinal direction at entry end 28 of the wheel is indicated at point C while the position of axis 24 (or 24*a*) at exit end 30 is indicated at point A. Additional details of the especially preferred embodiments of the invention are described in the following illustrative nonlimiting Example.

EXAMPLE 1

Figure 10:
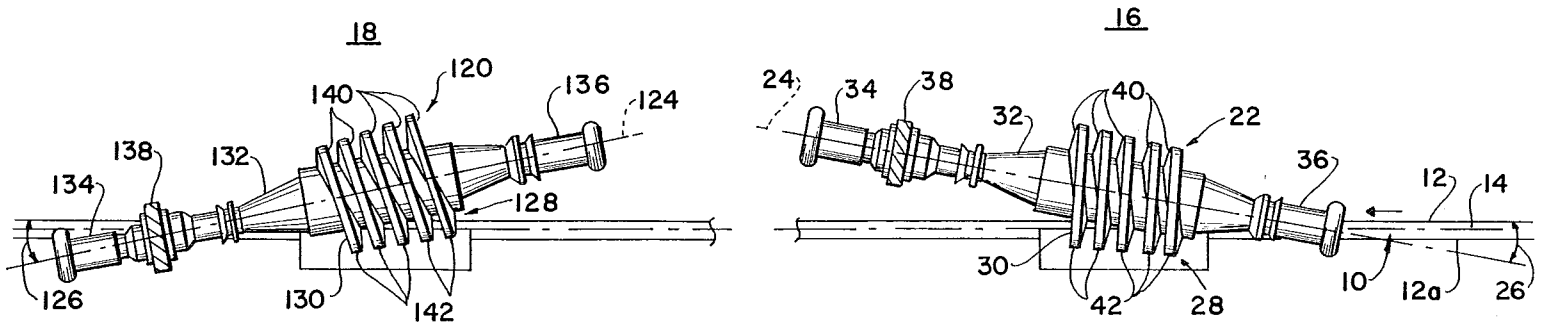
FIG. 10 is a more detailed side view of an illustrative arrangement of apparatus of the invention used in the manufacture of razor blades.

The arrangement of the especially preferred apparatus used in this Example is described in connection with FIGS. 1, 2, 3, 7 and 10. As shown, abrading station 16 includes two juxtaposed, interconnecting helical wheels including helical wheel 20 arranged in interconnection with another helical wheel (22) as shown in FIGS. 2, 3 and 10. Multiple helix wheels such as double, triple, quadruple, etc. helix wheels are preferred since they provide completely balanced metal removal without burrs or wire and also provide balanced wheel wear. Additionally, multiple helix wheels provide a tighter nip action with larger normal forces on the abrasive particles resulting in increased metal removal and higher blade speeds. Moreover, the tighter nip can reduce the effects of wheel wear. Each wheel (20 and 22) was between about 6.5 to about 7.5 inches long and had an entry diameter of between about 6.0 to about 5.75 inches, an exit diameter of between about 6.05 to about 5.80 inches and a total taper (hyperbolic) of between about 0.02 to about 0.05 inches or between about 0.01 to about 0.025 inches per side. Axes 24 and 24' of each wheel were arranged in a common plane to provide a tilt angle 26 of between about 0.75° to about 1.25° relative to the path of edge 12. The tilt angle provided an entry. abrading angle of between about 5.5° to about 8° at entry end 28 and an exit abrading angle of between about 8.0° to about 10.0° at exit end 30 for each wheel.

Each wheel 20 and 22 was divided into four sections as shown in FIG. 7. The preferred abrasive materials for use with wheels 20 and 22 are resin or vitrified bonded cubic boron nitride. Preferably, section 70, (FIG. 7) adjacent entry end 28, includes between about 6 to about 8 lands 40 and each land 40 carried an abrasive surface 42 which included resin bonded abrasive material having an average particle size of between about 50 to about 70 microns to thereby provide a relatively high degree of coarseness for section 70. Preferably, section 72 includes between about 5 to about 6 lands carrying abrasive surfaces 42 with each surface including resin bonded abrasive material having an average particle size of between about 20 to about 40 microns. Section 74 preferably includes about 3 to about 4 lands 40. Resin bonded abrasive material of each abrasive surface 42 in section 74 had an average particle diameter of between about 10 to about 20 microns. Section 76 preferably includes between about 0.5 to about 2 lands and, each abrasive surface 42 of section 76 included resin bonded abrasive having an average particle size of between about 5 to about 7 microns. The preferred width of abrasive surfaces 42 is between about 0.1 to about 0.2 inch.

The surface configuration of each of the above-described wheels were modified (or dressed) substantially in accordance with the methods disclosed and claimed in commonly owned U.S. Pat. No. 3,566,854 to provide a substantially straight line of intersection between the two wheels. U.S. Pat. No. 3,566,854 is also incorporated herein in its entirety by reference. The two wheels were mounted in bearing blocks at abrading station 16 so that their axes were parallel and inclined to provide a reverse tilt angle 26 of about 1° relative to plane 14. A grease was applied to the wheels and the wheels were gently fed into blade edge 12 to determine the precise abrading head setting. The setting of spindles 32 were then adjusted to obtain uniform blade edge contact over the entire length of the wheels.

In the preferred embodiment of the invention, abrading station 18 includes the finish honing abrading means of U.S. Pat. No. 3,461,616. A representative preferred finish honing abrading means includes two juxtaposed, interconnecting helical wheels including wheel 120 arranged with the other juxtaposed interconnecting wheel in the manner described and shown in U.S. Pat. No. 3,461,616. Each wheel was between about 2.5 to about 3.5 inch long and included between about 5 to about 7 lands 140 and each land 140 carried an abrading surface 142 which includes a resin bonded, hard, metallic oxide abrasive having an average particle size of between about 7 to about 9 microns. The entry diameter of each wheel was between about 6.0 to about 5.5 inches, the exit diameter was between about 5.9 to about 5.4 inches and the total taper (hyperbolic) of each wheel was between about 0.09 to about 0.11 inches or between about 0.045 to about 0.055 inches per side. Axes 124 of wheels 120 and the juxtaposed interconnecting helical wheel 122 (not shown) were arranged to provide a tilt angle 126 of between about 4.5° to about 5.5° relative to the path of edge 12. This tilt angle provided an included entry abrading angle for each wheel of between about 26° to about 32° at entry ends 128 and an included exit abrading angle of between about 16° to about 20° at exit end 130 for each wheel.

Each wheel was mount-de on a spindle 132 including bearing mounts 134, 136 with a drive gear 138 arranged on each spindle between the bearing mounts and the wheels. Spindles 132 were mounted in suitable bearing blocks (not shown) for rotation. The diameter of each wheel changed along its length so that each wheel was effectively tapered. Accordingly, the abrading angle between abrading surfaces 142 at the nip formed between the interconnecting wheels changed along the length of wheel 120 and the juxtaposed interconnecting wheel 122. As mentioned, the abrading angle at entry ends 128 of the wheels was higher than the abrading angle at exit ends 130. In this way, edge 12 was abraded initially at a relatively high included angle of abrading and the included angle of abrading progressively decreases as edge 12 is moved toward exit ends 130 of the wheels. As disclosed in U.S. Pat. No. 3,461,616, the abrading action achieved in abrading station 18 provides finished honed or edge facets 52 (FIG. 5) at opposed edge surfaces of cutting surface 50. Edge facets 52 have a convex surface in which the included angle of the facet surfaces progressively and substantially continuously decreases as the distance from edge 54 increases.

In representative on-line, high volume razor blade test production runs including abrading stations 16 and 18 described above, a blade strip was fed through the stations at a speed of about 160 feet per minute. Wheels 20 and 22 were rotated in opposite directions at speeds of about 4500 rpm and wheels 120 and 122 were rotated in opposite directions at speeds of about 3600 rpm to contact the blade edge 12 from opposite sides in a downward direction. Representative average production rates were about 76,800 blades per hour. Moreover, blades of consistently uniform high quality were continuously produced at the high production rates over extended periods of time without interruption of the run for equipment maintenance or adjustments such as returing of the wheels. The average continuous time of operation for a series of test runs was about 8 hours but some test runs were run continuously without interruption for 8 hours or more without effect on the high quality of the blades. Based on the test runs, the invention presents to the art relatively simple but extremely efficient, highly cost effective processes and apparatus for the high speed, mass volume production of razor blades having an excellent combination of performance characteristics.

The above description of the invention has been directed to an embodiment providing a cutting surface 50 including rough honed facets 56 and cutting edge facets 52 on opposed surfaces of top edge 12 of strip 10. However, the invention can also provide a similar cutting surface on bottom edge **12*a* to provide double edge razor blades. In on-line test production runs for producing double edge razor blades in accordance with the invention, two juxtaposed, inter-connecting wheels substantially identical to wheels 20 and 22 of station 16 (FIGS. 2, 3 and 10) were arranged in abrading relationship with bottom edge 12*a* in substantially the same manner as described before for the arrangement of wheels 20 and 22 with top edge 12. However, the plane of the axes of the wheels arranged for abrading edge 12*a* was reversed. In other words, edge 12*a* was subjected to substantially the same abrading action applied to edge 12 by wheels 20 and 22. However, the plane of the axes of the wheels for abrading edge 12*a* was inclined upwardly toward the path of edge 12*a* (i.e., plane 14) to provide the same tilt angle achieved by declining the plane of axes 24 and 24*a* of wheels 20 and 22 toward the path of edge 12 as shown in FIGS. 3 and 10. In on-line test production runs, two juxtaposed inter-connecting wheels substantially identical to wheels 120 and 122 (FIG. 10) were positioned after station 18 to provide edge facets 52 on surface 12*a*. The wheels were arranged in substantially the same abrading relationship with edge 12*a* as described for wheels 120 and 122. However, the plane of the axes of the wheels abrading surface 12*a* was inclined downwardly away from the plane of path of edge 12*a* to provide the same tilt angle achieved by inclining the plane of axes 124 upwardly away from the path of edge 12 as shown in FIG. 10**. Average production rates of double edge razors in on-line test production runs were about 36,000 blades per hour.

From the above description it should be apparent that the processes and apparatus of the invention provide distinctive and unexpected advantages. The combination of the reverse tilt angle blade stock concurrently with progressively decreasing degrees of coarseness at progressively increasing included angles of abrading effectively combines the grind and rough honed facet operations into a single operation. The use of the helical wheels provides completely balanced metal removal and balanced wheel wear. Moreover, the helical wheels provide a tighter nip which contributes to more rapid removal of metal and higher blade speeds and the tighter nip reduces the effects of wheel wear. These features cooperate with the reverse tilt angle and the abrading capability to provide an abrading action which is extremely reliable and efficient and eliminates the need for the automatic control means presently used to monitor and control the grind and rough honed facet operations. Additionally, the abrading action achieved in the present invention is designed so that the coarser abrading action removes the major portion of the metal in a direction into the strip edge while the finer abrading action removes the lesser portion of the metal and is also directed into the edge. This abrading action provides an extremely efficient removal of metal at increased high speeds. Accordingly, the processes and apparatus of the present invention provide unexpected advantages over processes and apparatus known to the art at the time the present invention was made.

I claim:

1. A method for forming a facet on opposed surfaces terminating at an edge of a cutting instrument, said method comprising the step of abrading the surfaces with a pair of juxtaposed wheels, each wheel having an axial length defining an entry and an exit end, said wheels being arranged and adapted to concurrently abrade the surfaces with progressively decreasing degrees of coarseness at progressively increasing angles of abrading as the surfaces are moved from the entry to the exit ends to thereby form a facet on each opposed surface in which the included angle of the facet surfaces decreases as the distance from the edge increases.

2. A method of claim 1 wherein the angle of abrading at the entry end is between about 10° to about 17° and the angle progressively increases to between about 14.5° to about 21.5°.

3. A method of claim 1 where the opposed surface portions are abraded with a cubic boron nitride.

4. A method for providing a facet on opposed surfaces of a razor blade material, said method including the steps of:

a. providing juxtaposed wheels rotatable about coplanar axes defining a plane, each wheel having an axial length including an entry end where the wheels have a relatively high degree of coarseness and thereafter the wheels have progressively decreasing degrees of coarseness, b. providing a path for moving opposed surfaces of the material into abrading relationship with the wheels, c. arranging the plane and the path to provide a tilt angle between the plane and path to thereby provide a relatively low angle of abrading at the entry end and progressively increasing angles of abrading along the axial length of the wheels, d. rotating said wheels in opposite directions, and e. moving the opposed surfaces along the path into contact with the rotating wheels so that the wheels contact the opposed surfaces in abrading relationship along the axial length of the wheels.

5. A method of claim 4 where the tilt angle is between about 0.3° to about 10°.

6. A method of claim 5 where the relatively low angle of abrading is between about 10° to about 17° and the included angle of abrading increases to between about 14.5° to about 21.5°.

7. A method of claim 4 wherein the wheels provide or carry an abrasive surface comprising a cubic boron nitride.

8. A method of claim 4 further including the step of abrading opposed surfaces of the facet to provide cutting edge facets on the surfaces.

9. A method of claim 8 wherein the opposed surfaces are abraded initially at a relatively high angle of abrading and thereafter at progressively decreasing angles of abrading to form cutting edge facets having convex surfaces.

10. Apparatus for providing a facet on opposed surfaces of a cutting instrument, said apparatus comprising:

a. abrading means including two juxtaposed abrading wheels rotatably mounted about coplanar axes defining a plane, each wheel having entry and exit ends and providing a relatively high degree of coarseness at the entry end and progressively decreasing degrees of coarseness toward the exit end, and b. guide means for moving opposed surfaces of the instrument along a path, said guide and abrading means being arranged to provide a tilt angle between the plane and the path and so that the plane and path diverge along the direction of movement of the instrument past the abrading wheels whereby the wheels provide a relatively low angle of abrading at the entry end and progressively increasing angles of abrading toward the exit end.

11. Apparatus of claim 10 where the tilt angle is between about 0.3° to about 10°.

12. Apparatus of claim 10 where the relatively low angle of abrading is between about 10° to about 17° and the angle of abrading increases to between about 14.5° to about 21.5°.

13. Apparatus of claim 10 where the axes are substantially parallel.

14. Apparatus of claim 10 where the wheels provide or carry an abrasive surface comprising a cubic boron nitride.

15. Apparatus of claim 10 where each abrading wheel is of generally frustoconical configuration having helical grooves formed in its circumferential surface defining helical lands and the helical lands are interengaged to form a nip.

16. Apparatus of claim 15 where the helical lands carry an abrasive surface.

17. Apparatus of claim 10 further including second abrading means comprising two juxtaposed abrading wheels rotatably mounted on parallel axes substantially parallel to the path and arranged and adapted to abrade opposed surfaces of the facets to provide cutting edge facets on the surfaces.

18. Apparatus of claim 10 further including second abrading means comprising two juxtaposed abrading wheels having entry and exit ends and rotatably mounted on parallel axes defining a second plane arranged to provide a tilt angle between the second plane and the path and each wheel has a relatively high angle of abrading at the entry end and progressively decreasing angles of abrading toward the exit end.

19. Apparatus of claim 18 where the tilt angle of the second abrading means is between about 3° to about 8.5°.

20. Apparatus of claim 18 where the relatively high angle of abrading of the second abrading means is between about 25° to about 33° and the angle of abrading at the exit end is between about 14° to about 22°.

21. Apparatus of claim 18 where each abrading wheel of the second abrading at means is of generally frustoconical configuration having helical grooves formed in its circumferential surface defining helical lands and the helical lands are interengaged to form a nip.

* * * * *